US010827797B2

(12) United States Patent
Hsu

(10) Patent No.: US 10,827,797 B2
(45) Date of Patent: Nov. 10, 2020

(54) MINIMALIST BAREFOOT SHOES FOR CORRECTING FLATFEET

(71) Applicant: Wen-Hua Hsu, Kaohsiung (TW)

(72) Inventor: Wen-Hua Hsu, Kaohsiung (TW)

( * ) Notice: Subject to any disclaimer, the term of this patent is extended or adjusted under 35 U.S.C. 154(b) by 122 days.

(21) Appl. No.: 16/285,672

(22) Filed: Feb. 26, 2019

(65) Prior Publication Data

US 2019/0269197 A1 Sep. 5, 2019

(30) Foreign Application Priority Data

Mar. 2, 2018 (TW) ..... 107106957 A

(51) Int. Cl.
*A43B 7/14* (2006.01)
*A43B 7/26* (2006.01)
(Continued)

(52) U.S. Cl.
CPC ..... *A43B 7/1495* (2013.01); *A43B 3/126* (2013.01); *A43B 7/142* (2013.01); *A43B 7/143* (2013.01);
(Continued)

(58) Field of Classification Search
CPC .. A43B 7/00; A43B 7/005; A43B 7/02; A43B 7/025; A43B 7/04; A43B 7/06; A43B 7/08; A43B 7/081; A43B 7/082; A43B 7/084; A43B 7/085; A43B 7/087; A43B 7/088; A43B 7/10; A43B 7/105; A43B 7/12; A43B 7/125; A43B 7/14; A43B 7/1405; A43B 7/141; A43B 7/1415; A43B 7/142; A43B 7/1425; A43B 7/143; A43B 7/1435; A43B 7/144; A43B 7/1445; A43B 7/145; A43B 7/146; A43B 7/1465; A43B 7/147; A43B 7/1475; A43B 7/148; A43B 7/1485; A43B 7/149; A43B 7/1495;
(Continued)

(56) References Cited

U.S. PATENT DOCUMENTS 1,283,335 A * 10/1918 Shillcock ..... A43C 11/1493 36/170
1,443,844 A * 1/1923 Jensen ..... A61F 13/066 602/66
(Continued)

FOREIGN PATENT DOCUMENTS

WO WO 87/02885 A1 5/1987
WO WO 2010/059346 A1 5/2010

*Primary Examiner* — Shaun R Hurley
*Assistant Examiner* — Bao-Thieu L Nguyen
(74) *Attorney, Agent, or Firm* — Birch, Stewart, Kolasch & Birch, LLP

(57) ABSTRACT

A pair of minimalist barefoot shoes has two shoe units. Each shoe unit has a shoe member, a medial arch pulling member, and a pressing member. The shoe member has a shoe body, a toe member, and a sole. The shoe body has a medial arch segment, an instep lateral segment, a receiving space, an opening, and an attachment layer. The medial arch pulling member is mounted on the shoe member and has a pulling segment and a connection layer. The pressing member is mounted on the shoe body and has a pressing segment and a combination layer. The pressing segment is attached securely to the shoe body, extends around an medial arch segment of the shoe body, and covers the first end of the medial arch pulling member.

8 Claims, 6 Drawing Sheets

(51) Int. Cl.
*A43B 3/12* (2006.01)
*A43C 11/14* (2006.01)
*A43B 23/22* (2006.01)

(52) U.S. Cl.
CPC ..... *A43B 7/26* (2013.01); *A43B 23/227* (2013.01); *A43C 11/1493* (2013.01)

(58) Field of Classification Search
CPC .... A43B 7/16; A43B 7/18; A43B 7/19; A43B 7/20; A43B 7/22; A43B 7/223; A43B 7/226; A43B 7/24; A43B 7/26; A43B 7/28; A43B 7/30; A43B 7/32; A43B 7/34; A43B 7/36; A43B 7/38; A43B 23/227; A43B 3/126
See application file for complete search history.

(56) References Cited

U.S. PATENT DOCUMENTS 3,327,410 A * 6/1967 Park, Sr. ..... A43C 11/1493 36/89
4,411,077 A * 10/1983 Slavitt ..... A43B 5/00 36/114
4,441,265 A * 4/1984 Burns ..... A43B 5/00 36/114
4,621,648 A * 11/1986 Ivany ..... A43B 5/00 36/89
4,640,025 A * 2/1987 DeRenzo ..... A43C 11/1493 36/114
4,753,228 A * 6/1988 Selner ..... A61F 13/066 36/89
4,811,498 A * 3/1989 Barret ..... A43B 7/1495 36/117.2
4,878,504 A * 11/1989 Nelson ..... A61F 13/066 602/27
5,016,623 A * 5/1991 Krahenbuhl ..... A61F 13/066 128/882
5,257,969 A * 11/1993 Mance ..... A61F 5/0113 36/8.3
D346,686 S * 5/1994 Hatfield ..... D2/973
D350,204 S * 8/1994 Mance ..... D24/192
5,499,461 A * 3/1996 Danezin ..... A43B 5/0401 36/117.1
5,620,413 A * 4/1997 Olson ..... A61F 5/0111 602/27
5,701,689 A * 12/1997 Hansen ..... A43B 5/0401 36/115
6,272,772 B1 * 8/2001 Sherman ..... A43B 5/16 36/89
6,772,541 B1 * 8/2004 Ritter ..... A43B 7/14 36/50.1
8,006,410 B2 * 8/2011 Romboli ..... A43C 11/1493 36/88
8,302,329 B2 * 11/2012 Hurd ..... A43B 23/08 36/88
D757,415 S * 5/2016 Spring ..... D2/970
9,668,534 B2 * 6/2017 Normand ..... A43B 5/10
9,907,363 B2 * 3/2018 Smith ..... A43C 11/1493
10,004,296 B2 * 6/2018 Zadnik ..... A43B 3/06
10,299,541 B2 * 5/2019 Bishop ..... A43B 7/28
D858,080 S * 9/2019 Petrie ..... D2/973
10,441,451 B2 * 10/2019 Ostergard ..... A43C 15/16
10,716,356 B2 * 7/2020 Bell ..... A43B 1/0081
2002/0088144 A1 * 7/2002 Katz ..... A43B 7/1495 36/88
2003/0066207 A1 * 4/2003 Gaither ..... A43C 3/02 36/50.1
2005/0268485 A1 * 12/2005 Sakai ..... A43C 11/14 36/11.5
2007/0277398 A1 * 12/2007 Davis ..... A43B 1/0081 36/50.1
2009/0247920 A1 * 10/2009 Clements ..... A61F 5/0127 602/27
2011/0010965 A1 * 1/2011 Shepherd ..... A43B 23/047 36/114
2011/0113650 A1 * 5/2011 Hurd ..... A43B 7/20 36/107
2012/0297645 A1 11/2012 Berbert
2013/0118031 A1 5/2013 Chenciner
2013/0255105 A1 * 10/2013 Bishop ..... A43B 3/126 36/88
2015/0096196 A1 * 4/2015 Normand ..... A43B 3/0005 36/89
2016/0270484 A1 * 9/2016 Zadnik ..... A43B 23/0205
2017/0127752 A1 5/2017 Kilgore et al.
2017/0224055 A1 * 8/2017 Hooper ..... A43B 13/14
2018/0242692 A1 * 8/2018 Houng ..... A43C 11/1493
2018/0289100 A1 * 10/2018 Bell ..... A43C 11/00
2019/0045886 A1 * 2/2019 Hatfield ..... A43B 3/0036
2019/0313742 A1 * 10/2019 Bell ..... A43C 5/00
2020/0205524 A1 * 7/2020 Hatfield ..... A43C 11/008

* cited by examiner

MINIMALIST BAREFOOT SHOES FOR CORRECTING FLATFEET

BACKGROUND OF THE INVENTION

1. Field of the Invention

The present invention relates to minimalist barefoot shoes for correcting pronation feet, and more particularly to minimalist barefoot shoes for flatfeet to provide an upward pulling force to medial arches of the feet of a user.

2. Description of Related Art

In ancient ages, human walked barefoot. When humans walk barefoot on sand or soil ground, the sand or soil conformed to the structure of each human's foot. Consequently, uneven surfaces easily causes humans to easily fall down. In the present age, the surfaces may be coated with asphalt to form a hard surface. The hard surface allowed humans to walk on a variety of surfaces without falling down.

However, when a person steps or walks on a modern surface, the weight of that person is supported by only a portion of the foot plate that is in contact with the hard surface. The medial arches of the feet of a person are not in contact with the ground and cannot support the weight of the person. Therefore, walking on a hard surface easily causes over pronation of the feet. In addition, a toddler learning to walk usually wears a pair of shoes that covers the feet, and the conventional shoes easily cause unsound development of their feet and causes soft tissues of feet, such as muscle, myofascial, tendon, or ligament, to weaken or loosen. Accordingly, over pronation and unsound development of feet easily cause the arches to collapse and cause functional flatfeet. Accordingly, the arches will lose their resilience and shock-absorbing function, and the arrangement of bones, such as calcaneal, navicular, or talus and the angles of the media longitudinal arch and front transverse arch will be altered. Consequently, this causes: 1) collapse of medial arches, 2) subluxation of the subtalar joint, 3) internal rotation of the tibia, and femur, and 4) knee valgus. When the femur internally rotates, the femoral head on the hip joint will push backward against the acetabular to cause pelvic torsion. The pelvic torsion causes asymmetry of lower limbs (functional leg length discrepancy), and then leads to scoliosis and soft tissue tension imbalance of the paraspine. This poor alignment scenario also causes soreness and pain of heel, knee, calf, and back. Therefore, the over pronation and unsound development of the feet are serious problems that need to be solved.

To overcome these problems, the present invention aims to mitigate or obviate the aforementioned problems.

SUMMARY OF THE INVENTION

The main objective of the invention is to provide a pair of minimalist barefoot shoes that can prevent unsound development of medial arches, over pronation of medial arches caused by stepping on a hard surface, functional flatfeet caused by collapse of arches, and then address proper arrangement of bone and joint biomechanic alignment problems.

The pair of minimalist barefoot shoes has two shoe units. Each shoe unit has a shoe member, a medial arch pulling member, and a pressing member. The shoe member has a shoe body, a toe member, and a sole. The shoe body has a medial arch segment, an instep lateral segment, a receiving space, an opening, and an attachment layer. The medial arch segment is formed on a first side of the shoe body. The instep lateral segment is formed on a second side of the shoe body opposite the first side. The receiving space is formed in the shoe body. The opening is defined in a top of the shoe body and communicates with the receiving space. The attachment layer is mounted on the shoe body at a position adjacent to the opening. The toe member is mounted on a front end of the shoe body and has five toe caps communicating with the receiving space in the shoe body. The sole is attached to a bottom of the shoe body and has a gap formed between the sole and the shoe body. The medial arch pulling member is mounted on the shoe member and has a pulling segment and a connection layer. The pulling segment is formed on a first end of the medial arch pulling member, is attached securely to the bottom of the shoe body at a position being adjacent to the medial arch segment of the shoe body, and is held in the gap between the sole and the shoe body. The connection layer is mounted on a second end of the medial arch pulling member opposite the first end of the medial arch pulling member, is mounted on a side of the medial arch pulling member facing the shoe body, extends around the medial arch segment of the shoe body from the bottom of the shoe body, extending inclinedly and upward to a position around the opening of the shoe body, and is connected detachably with the attachment layer of the shoe body. The pressing member is mounted on the shoe body and has a pressing segment and a combination layer. The pressing segment is formed on a first end of the pressing member, is attached securely to the shoe body at a position adjacent to the instep lateral segment of the shoe body, extends through the gap between the sole and the shoe body, extends around the medial arch segment of the shoe body, covers the first end of the medial arch pulling member, and extends inclinedly and upward to a position around the opening of the shoe body. The combination layer is mounted on the pressing member at an inner side of the pressing member facing the shoe body at a position adjacent to a second end of the pressing member opposite the first end of the pressing member.

Other objects, advantages and novel features of the invention will become more apparent from the following detailed description when taken in conjunction with the accompanying drawings.

DETAILED DESCRIPTION OF PREFERRED EMBODIMENT

Figure 1:
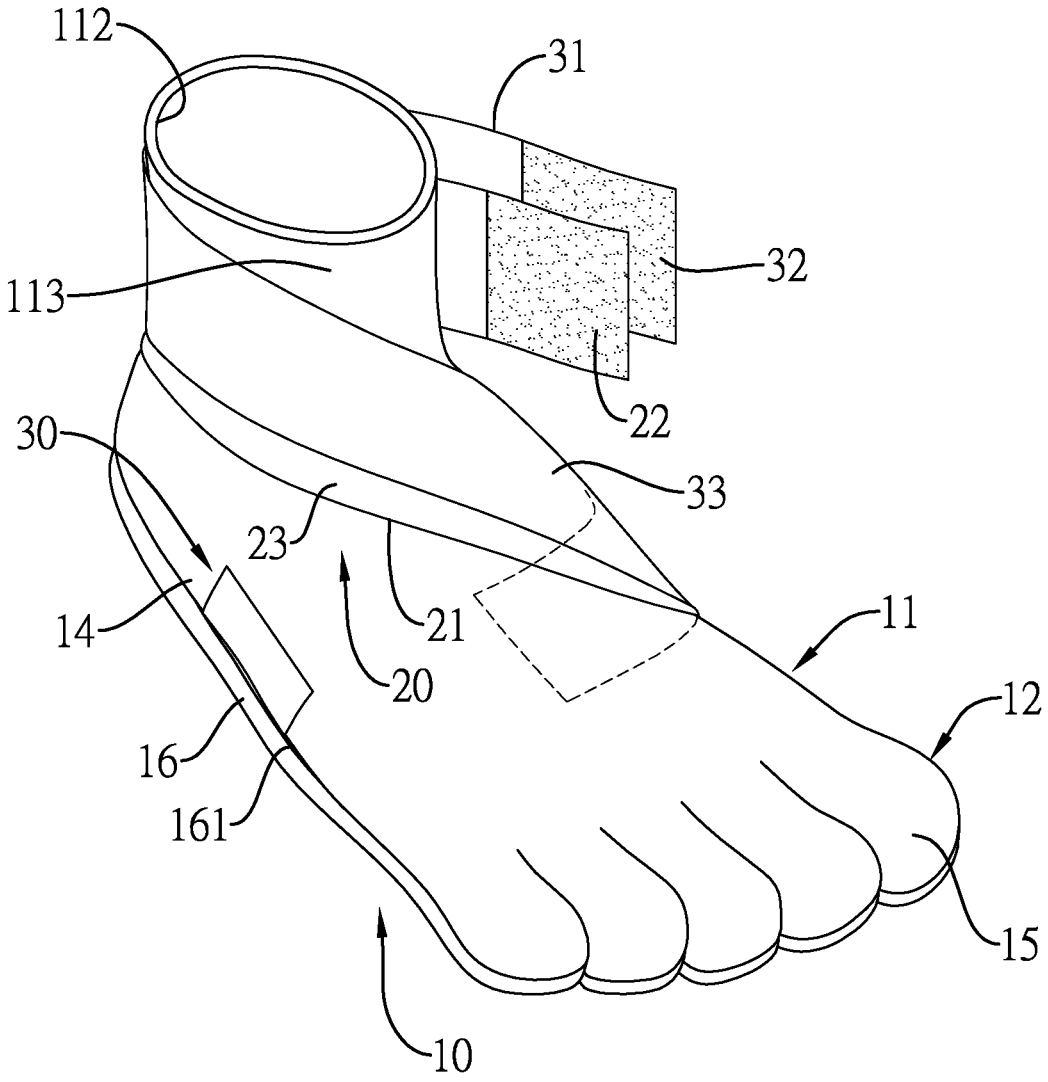
FIG. 1 is a perspective view of a shoe unit of a pair of minimalist barefoot shoes in accordance with the present invention.
Figure 2:
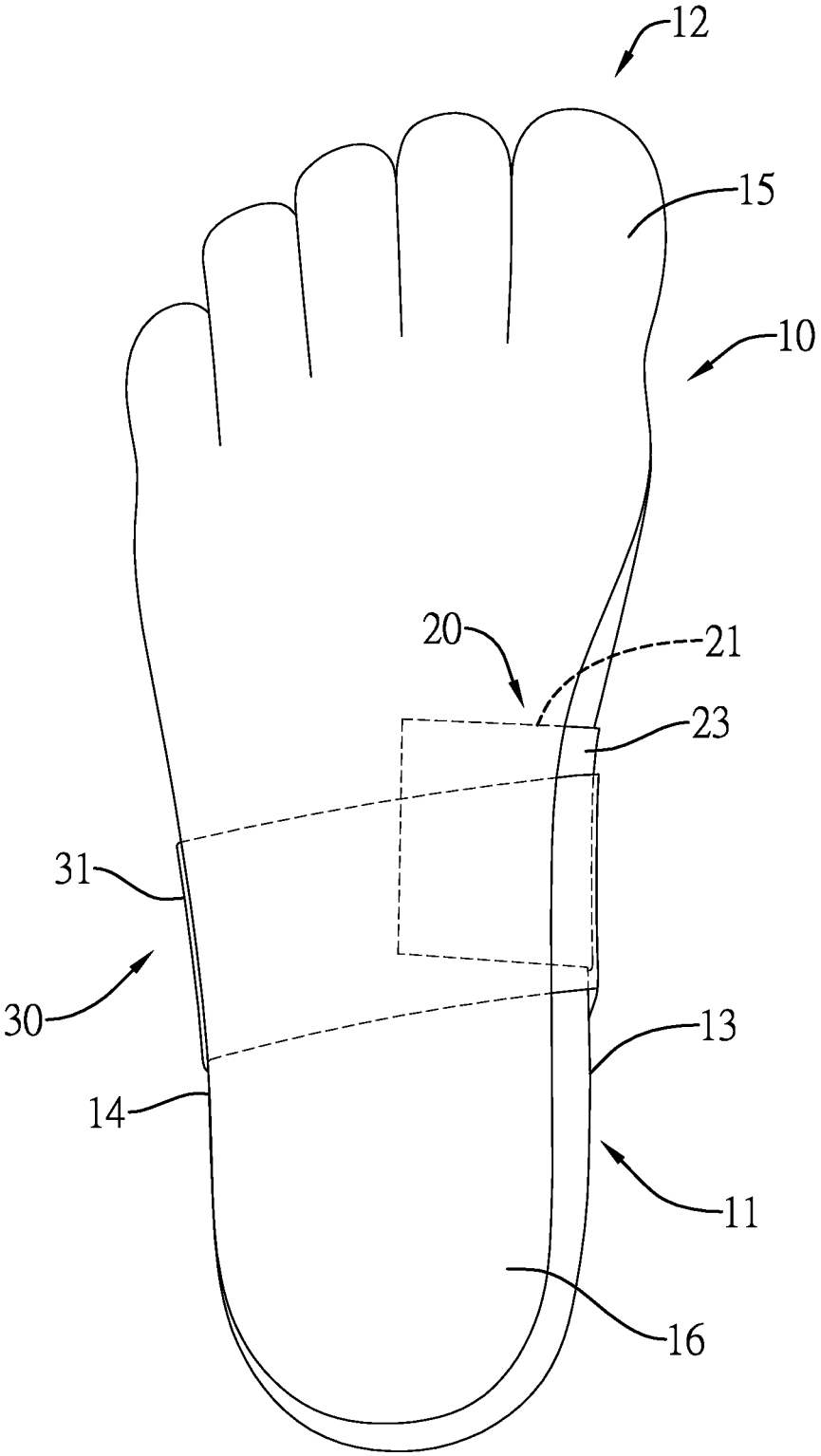
FIG. 2 is a top view of the shoe unit in FIG. 1.
Figure 3:
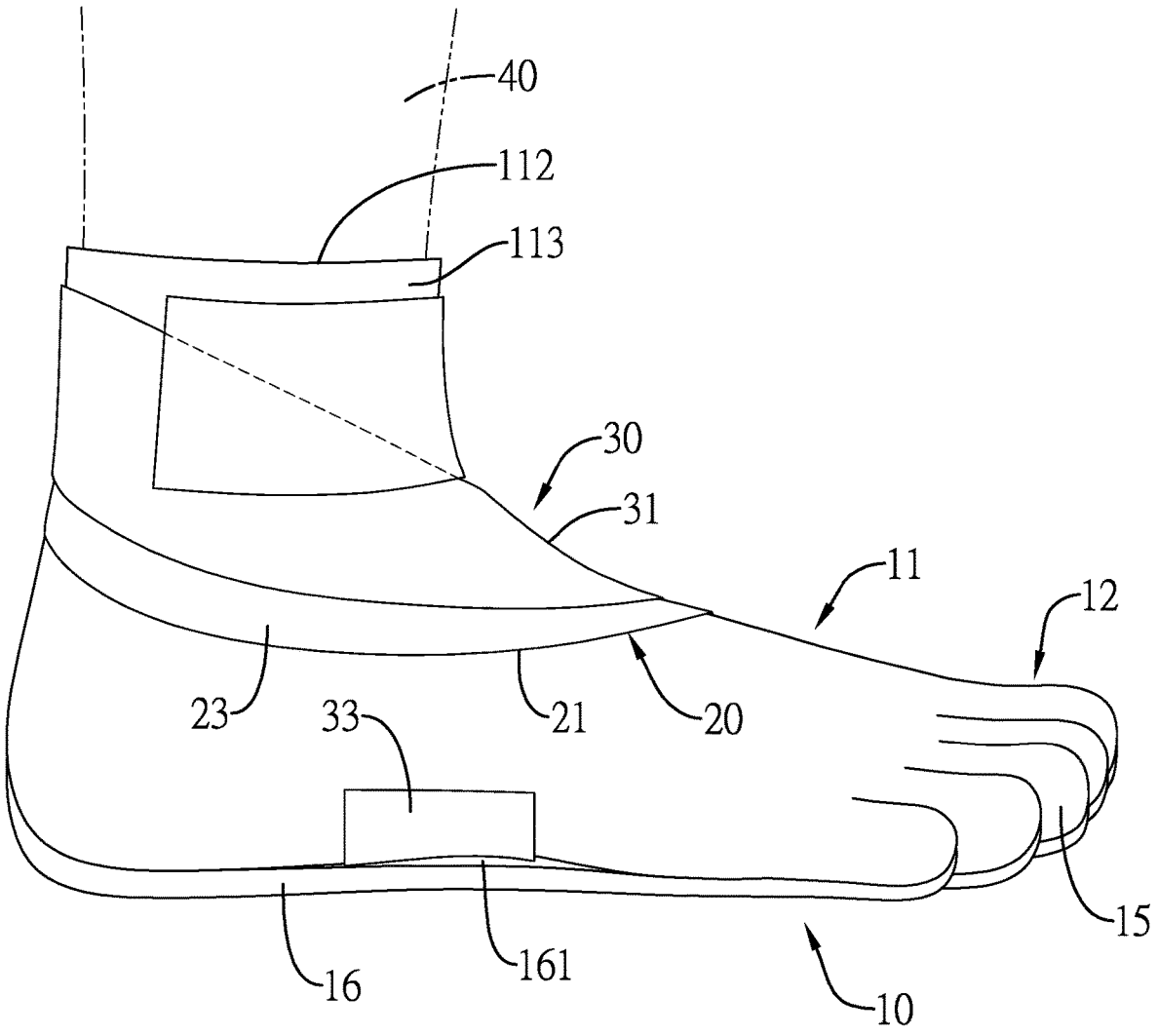
FIG. 3 is an operational side view of the shoe unit in FIG. 1.

With reference to FIGS. 1 to 3, a pair of minimalist barefoot shoes in accordance with the present invention comprises two shoe units. Each shoe unit comprises a shoe member 10, a medial arch pulling member 20, and a pressing member 30.

Figure 4:
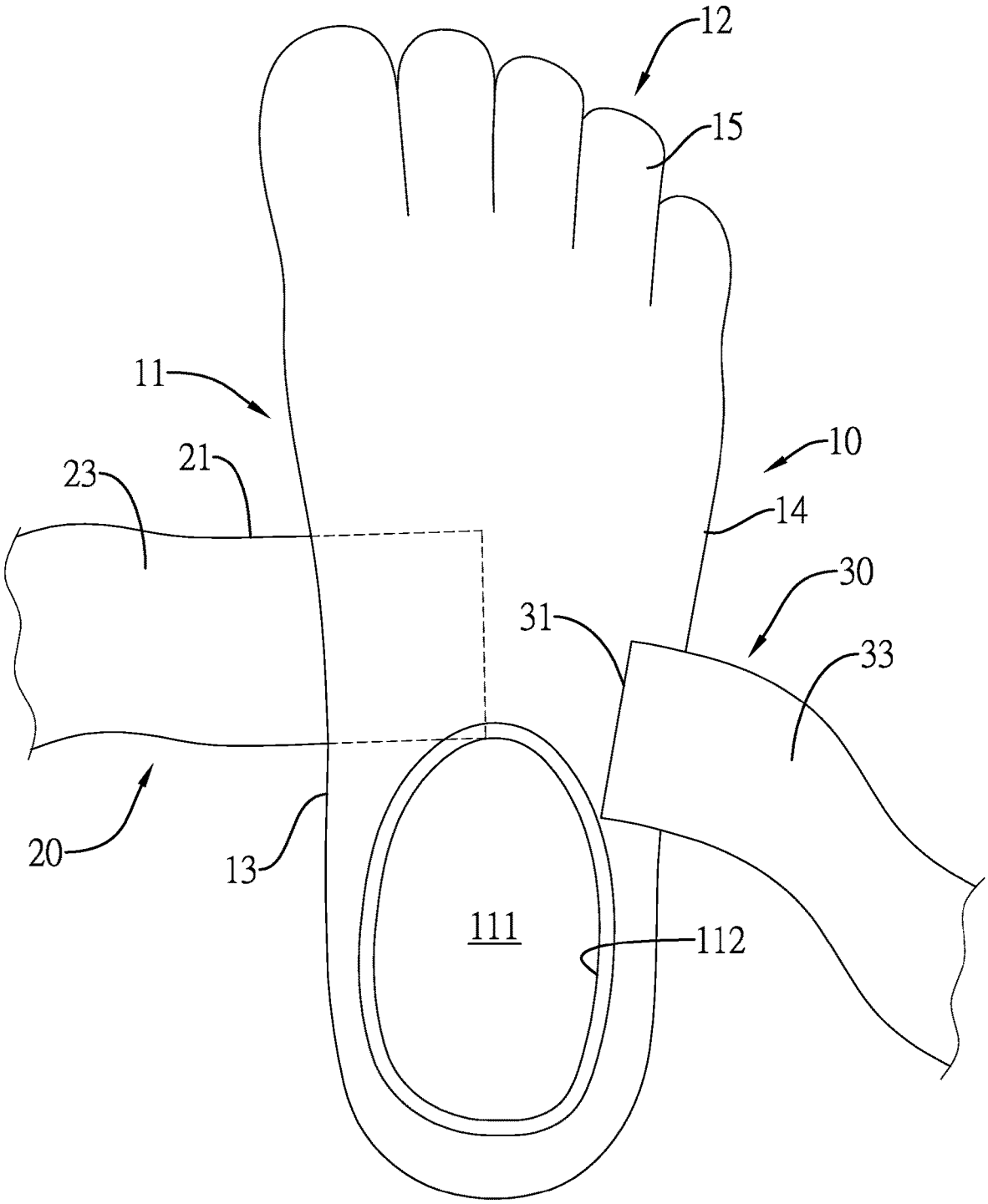
FIG. 4 is an operational top view of the shoe unit in FIG. 1.

With reference to FIGS. 1, 2, and 4, the shoe member 10 comprises a shoe body 11, a toe member 12, and a sole 16. The shoe body 11 has a medial arch segment 13 and an instep lateral segment 14. The medial arch segment 13 is formed on a first side of the shoe body 11. The instep lateral segment 14 is formed on a second side of the shoe body 11 opposite the first side. A receiving space 111 is formed in the shoe body 11, and an opening 112 is defined in a top of the shoe body 11 and communicates with the receiving space 111. An attachment layer 113 is mounted on the shoe body 11 at a position adjacent to the opening 112. Preferably, the attachment layer 113 is a loop connection strap. The toe member 12 is mounted on a front end of the shoe body and has five toe caps 15 communicating with the receiving space 111 in the shoe body 11. The toe caps 15 can be applied to hold toes of a wearer inside. The sole 16 is attached to a bottom of the shoe body 11 and a gap 161 is formed between the sole 16 and the bottom of the shoe body 11.

Figure 5:
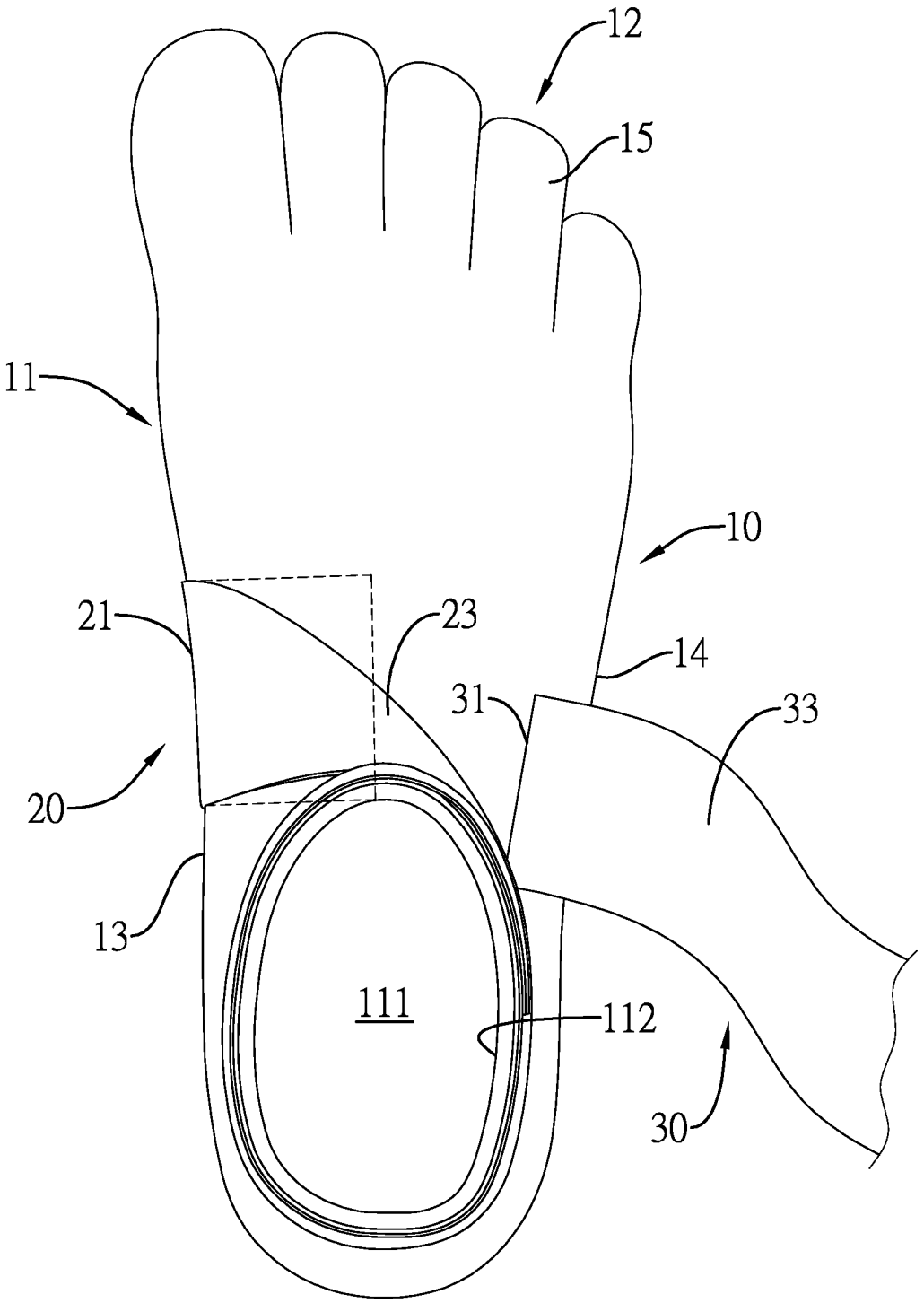
FIG. 5 is another operational side view of the shoe unit in FIG. 1.

With reference to FIGS. 1, 4, and 5, the medial arch pulling member 20 is mounted on the shoe member 10 and comprises a pulling segment 21 and a connection layer 22. The pulling segment 21 is formed on a first end of the medial arch pulling member 20, is attached securely to the bottom of the shoe body 11 at a position being adjacent to the medial arch segment 13, and is held in the gap 161 between the sole 16 and the shoe body 11. The connection layer 22 is mounted on a second end of the medial arch pulling member 20 opposite the first end of the medial arch pulling member 20 and is mounted on a side of the medial arch pulling member 20 facing the shoe body 11. The connection layer 22 extends around the medial arch segment 13 from the bottom of the shoe body 11, extends inclinedly and upward to a position around the opening 112 of the shoe body 11, and is connected detachably with the attachment layer 113 of the shoe body 11. In addition, the medial arch pulling member 20 further has an adhesive layer 23 mounted on a side of the pulling segment 20 opposite the shoe body 11. Preferably, the medial arch pulling member 20 is elastic, and the connection layer 22 is a hook connection strap and the adhesive layer 23 is a loop connection strap.

The pressing member 30 is mounted on the shoe body 11 and comprises a pressing segment 31 and a combination layer 32. The pressing segment 31 is formed on a first end of the pressing member 30 and is attached securely to the shoe body 11 at a position adjacent to the instep lateral segment 14. The pressing segment 31 extends through the gap 161 between the sole 16 and the shoe body 10, extends around the medial arch segment 13 of the shoe body 11, covers the first end of the medial arch pulling member 20, and extends inclinedly and upward to a position around the opening 112 of the shoe body 11. The combination layer 32 is mounted on the pressing member 20 at an inner side of the pressing member 30 facing the shoe body 11 at a position adjacent to a second end of the pressing member 30 opposite the first end of the pressing member 30. The combination layer 32 is selectively connected with one of the adhesive layer 23 of the medial arch pulling member 20 and the attachment layer 113 of the shoe body 11. In addition, the pressing member 30 further has an engagement layer 33 mounted on an outer side of the pressing member 30 and is selectively connected detachably with the combination layer 32 of the pressing member 30. Preferably, the combination layer 32 is a hook connection strap, and the engagement layer 33 is a loop connection strap. The pressing member 30 is elastic.

With reference to FIGS. 1, 4, and 5, when the minimalist barefoot shoe is in use, the medial arch pulling member 20 and the pressing member 30 are loosened first, and a user puts a foot into the shoe body 11 via the opening 112 to hold the foot inside the receiving space 111. The toes of the foot are held respectively in the toe caps 15 of the toe member 12, such that the toes of the wearer can move freely. Consequently, the second end of the medial arch pulling member 20 is pulled out from the gap 161 between the sole 16 and the shoe body 11 and is pulled to extend around the medial arch segment 13 and inclinedly toward the opening 112. Then, the second end of the medial arch pulling member 20 is mounted around the opening 112 and is connected with the attachment layer 113 with the connection layer 22. To improve the connection security of the medial arch puling member 20, the connection layer 22 can be connected with the adhesive layer 23. Accordingly, the medial arch pulling member 20 is connected securely with the shoe body 11 and provides a pulling force to the medial arch segment 13. Thus, the medial arch segment 13 can be provided with a first pulling effect.

Figure 6:
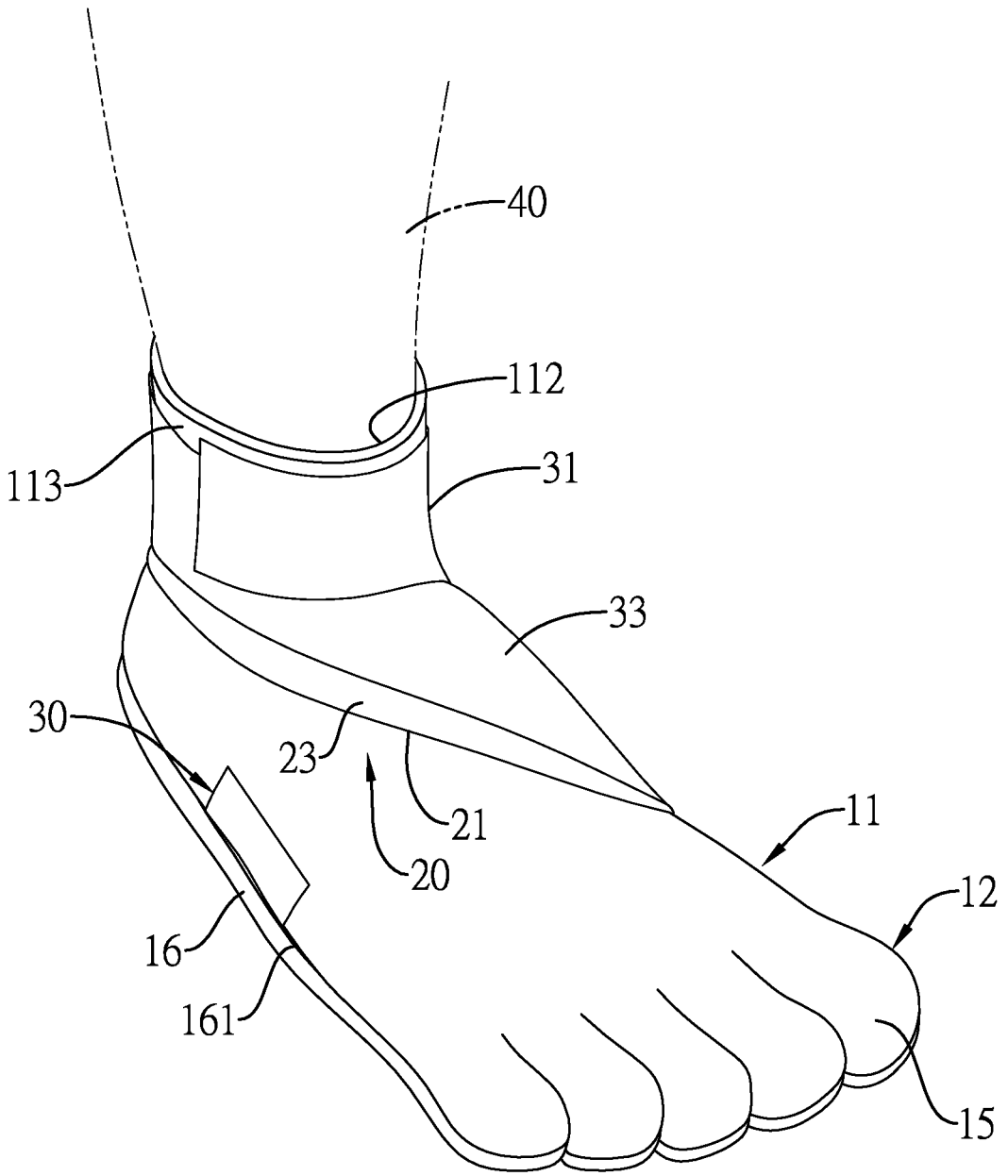
FIG. 6 is an operational perspective view of the shoe unit in FIG. 1.

With reference to FIGS. 1, 5, and 6, the second end of the pressing member 30 is inserted into the gap 161 from the second side of the shoe body 11 and covers the medial arch pulling member 20. At this time, the combination layer 32 is connected with the adhesive layer 23 on the medial arch pulling member 20. The second end of the pressing member 30 then extends out of the gap 161 from the first side of the shoe body 11 and around the medial arch segment 13. The second end of the pressing member 30 is then pulled to extend inclinedly toward the opening 112 and is mounted around the opening 112. The combination layer 32 of the pressing member 30 can be selectively connected with one of the adhesive layer 23 of the medial arch pulling member 20 and the attachment layer 113 of the shoe body 11. To improve the connection security of the pressing member 30, the combination layer 32 of the pressing member 30 can be further connected with the engagement layer 33. Accordingly, the pressing member 30 can also provide a pulling force to the medial arch segment 13, so that the medial arch segment 13 is provided with a second pulling effect.

With such an arrangement, when a user wears the minimalist barefoot shoes in accordance with the present invention, the toes of the wearer can move freely inside the toe member 12. Thus, the feet of the wearer can emulate walking as barefoot.

Furthermore, with the pulling forces provided by the medial arch pulling member 20 and the pressing member 30, the medial arch segment 13 can be pulled upwardly and the medial arch of the wearer can also be pulled upwardly to prevent the medial arches from collapsing. This prevents the individual's foot 40 from over pronation, medial arch collapse, and improper arrangement of biomechanic alignment. Accordingly, the muscle and joint soreness can be effectively mitigated.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pair of minimalist barefoot shoes comprising two shoe units, and each shoe unit comprising:

a shoe member comprising a shoe body having a medial arch segment formed on a first side of the shoe body;

an instep lateral segment formed on a second side of the shoe body opposite the first side;

a receiving space formed in the shoe body;

an opening defined in a top of the shoe body and communicating with the receiving space; and an attachment layer mounted on the shoe body at a position adjacent to the opening;

a toe member mounted on a front end of the shoe body and having five toe caps communicating with the receiving space in the shoe body;

a sole attached to a bottom of the shoe body; and a gap formed between the sole and the shoe body;

a medial arch pulling member mounted on the shoe member and comprising a pulling segment formed on a first end of the medial arch pulling member, attached securely to the bottom of the shoe body at a position being adjacent to the medial arch segment of the shoe body, and held in the gap between the sole and the shoe body; and a connection layer mounted on a second end of the medial arch pulling member opposite the first end of the medial arch pulling member, mounted on a side of the medial arch pulling member facing the shoe body, extending around the medial arch segment of the shoe body from the bottom of the shoe body, extending inclinedly and upward to a position around the opening of the shoe body, and connected detachably with the attachment layer of the shoe body; and a pressing member mounted on the shoe body and comprising a pressing segment formed on a first end of the pressing member, attached securely to the shoe body at a position adjacent to the instep lateral segment of the shoe body, extending through the gap between the sole and the shoe body, extending around the medial arch segment of the shoe body, covering the first end of the medial arch pulling member, and extending inclinedly and upward to a position around the opening of the shoe body; and a combination layer mounted on the pressing member at an inner side of the pressing member facing the shoe body at a position adjacent to a second end of the pressing member opposite the first end of the pressing member.

2. The pair of minimalist barefoot shoes as claimed in claim 1, wherein the medial arch puling member of each shoe unit further has an adhesive layer mounted on a side of the medial arch pulling member facing the pressing member of the shoe unit;

the combination layer of the pressing member of each shoe unit is selectively connected with one of the adhesive layer of the medial arch pulling member and the attachment layer of the shoe body of the shoe unit; and the pulling segment of the medial arch pulling member and the pressing segment of the pressing member of each shoe unit are elastic.

3. The pair of minimalist barefoot shoes as claimed in claim 2, wherein the pressing member of each shoe unit further has an engagement layer mounted on an outer side of the pressing member and connected detachably with the combination layer of the pressing member.

4. The pair of minimalist barefoot shoes as claimed in claim 1, wherein the pressing member of each shoe unit further has an engagement layer mounted on an outer side of the pressing member and connected detachably with the combination layer of the pressing member.

5. The pair of minimalist barefoot shoes as claimed in claim 4, wherein the connection layer and the combination layer of each shoe unit are hook connection straps; and the attachment layer, the adhesive layer, and the engagement layer of each shoe unit are loop connection straps.

6. The pair of minimalist barefoot shoes as claimed in claim 3, wherein the connection layer and the combination layer of each shoe unit are hook connection straps; and the attachment layer and the engagement layer of each shoe unit are loop connection straps.

7. The pair of minimalist barefoot shoes as claimed in claim 2, wherein the connection layer and the combination layer of each shoe unit are hook connection straps; and the attachment layer and the adhesive layer of each shoe unit are loop connection straps.

8. The pair of minimalist barefoot shoes as claimed in claim 1, wherein the connection layer and the combination layer of each shoe unit are hook connection straps; and the attachment layer of each shoe unit is a loop connection strap.

* * * * *